US007861380B2

(12) United States Patent
Moore et al.

(10) Patent No.: US 7,861,380 B2
(45) Date of Patent: Jan. 4, 2011

(54) REPLACEABLE HAND GRIP

(75) Inventors: Garry S. Moore, Chesterfield, VA (US); Joseph Battiston, Sutherland, VA (US)

(73) Assignee: Tubular Fabricators Industry, Inc., Petersburg, VA (US)

( * ) Notice: Subject to any disclaimer, the term of this patent is extended or adjusted under 35 U.S.C. 154(b) by 371 days.

(21) Appl. No.: 12/217,663

(22) Filed: Jul. 8, 2008

(65) Prior Publication Data

US 2009/0044380 A1 Feb. 19, 2009

Related U.S. Application Data

(63) Continuation-in-part of application No. 11/123,413, filed on May 6, 2005, now abandoned.

(60) Provisional application No. 60/569,468, filed on May 7, 2004.

(51) Int. Cl.
*B25G 1/10* (2006.01)

(52) U.S. Cl. ..... 16/421; 16/431; 16/422

(58) Field of Classification Search ..... 16/428, 16/422, 421, 431, DIG. 12; 294/171, 135, 294/165; 383/6, 13, 25, 29; 280/47.38, 47.371, 280/650; 190/115
See application file for complete search history.

(56) References Cited

U.S. PATENT DOCUMENTS

| | | | |
|---|---|---|---|
| 1,908,834 | A | 5/1933 | Engberg et al. |
| 3,981,043 | A | 9/1976 | Curry |
| 4,890,355 | A | 1/1990 | Schulten |
| 5,215,319 | A | 6/1993 | Farris |
| 5,216,780 | A | 6/1993 | Lutzke et al. |
| 5,348,360 | A | 9/1994 | Mencarelli et al. |
| 5,429,377 | A | 7/1995 | Duer |
| 5,458,145 | A | 10/1995 | Davis |
| 5,465,745 | A | 11/1995 | Davis |
| 5,640,741 | A | 6/1997 | Yano |
| 5,862,571 | A | 1/1999 | Naft |
| 5,915,712 | A | 6/1999 | Stephenson et al. |
| 6,065,764 | A | 5/2000 | Moseley |
| 6,196,562 | B1 | 3/2001 | Zhuang |
| 6,212,972 | B1 | 4/2001 | Yamane |
| 6,604,789 | B1 | 8/2003 | Downing |
| 6,817,066 | B1 | 11/2004 | Williams et al. |

FOREIGN PATENT DOCUMENTS

DE 19648520 A1 5/1998

*Primary Examiner*—Chuck Y. Mah
(74) *Attorney, Agent, or Firm*—Williams Mullen

(57) ABSTRACT

The replaceable elastic hand grip for framed mobility devices such as walkers that have a substantially elliptical gripping portion with at least one hole, the replaceable hand grip includes a substantially elliptical hand grip cover which includes an opening to form a C-shape cross section for securely installing the grip over the gripping portion of the frame of the mobility device. The hand grip further includes a mechanical means, such as a normally mounted pin on the inner surface of the grip cover that mates with the hole of the gripping portion of the mobility device so that the hand grip is prevented from slipping. The elastic and non-absorbent hand grip provides a replaceable, sanitary, stable grasping point for the user of the framed mobility device.

11 Claims, 8 Drawing Sheets

REPLACEABLE HAND GRIP

CROSS REFERENCE TO RELATED APPLICATIONS

The present application is a continuation-in-part of U.S. application Ser. No. 11/123,413 filed May 6, 2005 now abandoned, which claimed priority to U.S. Provisional Application Ser. No. 60/569,468, filed May 7, 2004, both of which are hereby incorporated by reference,

BACKGROUND OF THE INVENTION

1. Field of the Invention

The invention relates to hand grips and more particularly to an easily replaced hand grip for mobility, support, and seating devices.

2. Description of Related Art

Many types of mobility, support and seating devices include hand grips. For example, walkers, crutches and canes employ handles or hand grips. In previous devices, the hand grip is fixedly attached to the device, often by heat shrink fitting, and can not be removed by the consumer if damaged or soiled or for any other purposed. Instead, the device must be returned to the manufacturer if the hand grip needs to be replaced. Furthermore, if a walker, for example, is used by different people, sanitary issues arise. If such devices are provided on a rental basis for temporary use, it is costly and time consuming to replace the hand grip for subsequent users.

Some previously known grip apparatuses are for sanitary purposes and cover handles used by many individuals. The grips are disposable or reusable and provide protection against germs or other unsanitary conditions left by prior users. For example, U.S. Pat. No. 6,817,066 discloses a reusable cover for grocery cart handles. While such a device provides a sanitary grasp for a grocery cart handle, it does not provide a stable, non-slip gripping surface as such stability is not contemplated in such a use. Numerous other such covers are shown in U.S. Pat. Nos. 6,065,764, 5,429,377, 5,215,319 and many others. None of these devices provides a stable, non-slip hand grip.

Thus, it is desired to make available a hand grip which can be replaced easily when worn or when needed for sanitary reasons. Further, it is desired to make available a hand grip which can be replaced by the consumer. Finally, it is desired to make available a hand grip which attaches in a non-slip connection.

An object of the present invention is to provide a hand grip which can be replaced easily when worn or when needed for sanitary reasons.

An object of the present invention is to provide a hand grip which can be replaced by the consumer.

An object of the present invention is to provide a hand grip which attaches in a non-slip connection.

Finally, it is an object of the present invention to accomplish the foregoing objectives in a simple and cost effective manner.

SUMMARY OF THE INVENTION

The present invention addresses these needs by providing a replaceable, single piece hand grip for a framed device having a gripping portion with a substantially elliptical cross section, wherein the gripping portion defines an external surface with at least one hole, which is normal to the external surface.

The replaceable hand grip comprises a non-absorbent grip cover and at least one pin. The grip cover has a substantially elliptical cross section that corresponds approximately to the cross section of the gripping portion and defines an interior space that is adapted to receive the gripping portion. In particular, the grip cover defines an inner surface that is disposed on the portion of the grip cover that faces this interior space and an outer surface that is disposed on the grip cover that faces away from the inner surface. The outer surface of the grip cover is adapted to receive a user's hand. Optionally, the grip cover outer surface may be coated with a deformable material. At least one pin is mounted normally and integrally on the inner surface of the grip cover in a location corresponding to the at least one hole that is located in the gripping portion, single integrated piece with the grip cover.

The grip cover is fabricated from an elastic material and defines a longitudinally extending opening along its entire length. This means that the grip cover, with its substantially elliptical cross section and longitudinal opening forms a C-shaped spring. The C-shaped spring permits the grip cover to be deformed to expand the opening in the transverse direction. Expanding the opening in the transverse direction enables the grip cover to be placed around the gripping portion of the framed device, with the interior space receiving the gripping portion. When the grip cover is in place, it may be relaxed to relieve the deformation, with the effect that the elastic grip cover substantially surrounds the gripping portion.

In orienting the grip cover with respect to the gripping portion, the at least one pin is aligned with the at least one hole on the gripping portion, so as to engage the hole. The at least one pin thus extends from the inner surface of the grip cover for a sufficient length so as to extend into the at least one hole of the gripping portion when the grip cover is substantially surrounding the gripping portion of the framed device.

In one embodiment, the transverse width of the longitudinally extending opening is less than the width of the gripping portion when the grip cover is relaxed and not substantially surrounding the gripping portion. This enables a secure fit. Alternatively, the transverse arc of the longitudinally extending opening may be no more than 120-degrees when the grip cover is relaxed and not substantially surrounding the gripping portion.

The size of the cross section of the at least one pin may substantially proximate to the size of the cross section of the at least one hole. Optionally, the size of the cross section of the at least one pin is substantially proximate to the size of the cross section of the at least one hole, such that the pin is compressed upon its extending into or mating with the at least one hole. The pin may be mounted onto the inner surface of the grip cover at a point opposite the longitudinally extending opening, or in a different location on the inner surface as suitable for the application.

In some cases, a framed device may have an at least one hole on its gripping portion that extends through the gripping portion; in such case, the at least one pin may be provided having sufficient length to extend through the at least one hole and the gripping portion.

The replaceable hand grip of claim 1 wherein the at least one pin is hollow along its length so as to define an open hollow portion adapted to receive a fastener capable of engaging the hollow portion of the pin. In applications in which the at least one hole of the framed device extends through the gripping portion, the pin may be of sufficient length to extend through the at least one hole, and optionally such a pin may be hollow along its length so as to define an open hollow portion adapted to receive a fastener capable of engaging the hollow portion of the pin. Optionally, the foregoing embodiment of a pin may be adapted to receive fasteners such as a screw, a snap-in pin, or a pop rivet.

BRIEF DESCRIPTION OF THE DRAWINGS

A more complete description of the subject matter of the present invention and the advantages thereof, can be achieved by the reference to the following detailed description by which reference is made to the accompanying drawings in which.

ELEMENT LIST

Figure 1:
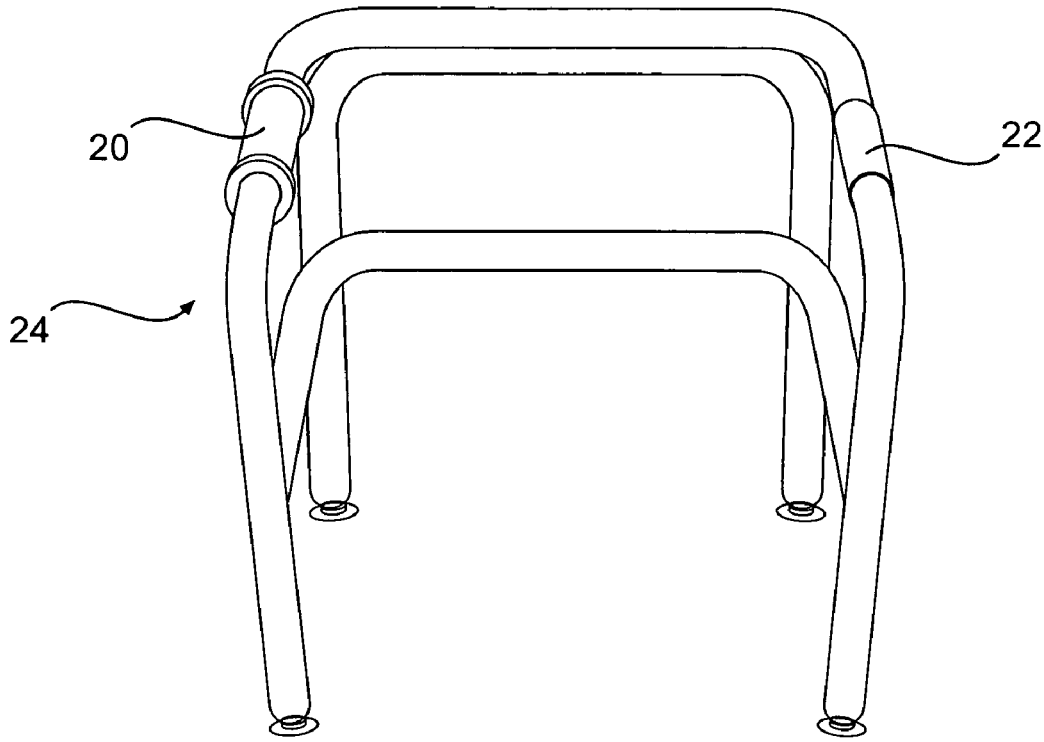
FIG. 1 PRIOR ART
FIG. 1 is a perspective view of a walker showing a prior art hand grip and a hand grip according to the present invention.

20 prior art hand grip
22 hand grip
22C grip cover
22P pin
22S interior space of the grip cover
22X inner surface of the grip cover
22Y outer surface of the grip cover
24 framed device
24G gripping portion of the framed device
25 lengthwise opening in the grip cover
26 hole in the gripping portion
28 hollow of the pin
29 fastener
30 end of grip
32 alternate embodiment of end of grip

DETAILED DESCRIPTION

The following detailed description is of the best presently contemplated modes of carrying out the invention. This description is not to be taken in a limiting sense, but is made merely for the purpose of illustrating general principles of embodiments of the invention. While the invention has been described as being for a walker, use with any mobility, support or seating device which includes a hand grip is contemplated.

As shown in the drawings, the present invention can be used on walkers. It can also be used on other framed devices having substantially elliptical cross sections at the gripping portions, such as canes; crutches; wheel chairs; bed, bath, support and shower rails; foot stools; grab bars; commode, bath and shower chairs; as well as other devices employing a hand grip.

FIG. 1 shows an example of a commonly used heat shrink fitted hand grip 20. This hand grip 20 is not removable by the consumer. Instead, the walker must be returned to the manufacturer if the handle needs to be replaced. Furthermore, if the walker is used by different people, sanitary issues arise. Thus, it is desired to make available a hand grip which can be replaced easily when worn or when needed for sanitary reasons. Further, it is desired to make available a hand grip which can be replaced by the consumer. Finally, it is desired to make available a hand grip which attaches in a non-slip connection.

FIG. 1 also shows one embodiment of the present invention in the form of a replaceable hand grip 22. A walker or other framed device 24 is commonly made from metal tubing having a cylindrical or elliptical cross section, which is bent, welded, screwed or riveted into the desired frame; typically such a tubular framed device normally includes vertical legs, horizontal hand gripping portions, and other structural components. The present invention can be used with devices made from metal tubing as shown, as well as with devices made from other materials such as wood, plastic or a composite, having an elliptical cross section. The present invention is functional with any material from which walkers and other mobility devices can be manufactured.

However, the invention is appropriate for such framed devices that have a gripping portion with an elliptical cross section and at least one hole in the gripping portion. Elliptical, for the purposes of this application, is intended to include the special ellipse of a circle.

Figure 2:
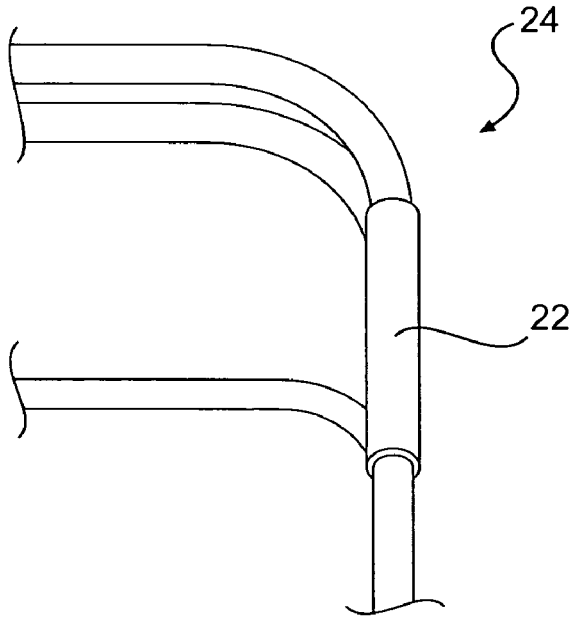
FIG. 2 is an enlarged view of the hand grip according to the present invention.
Figure 10:
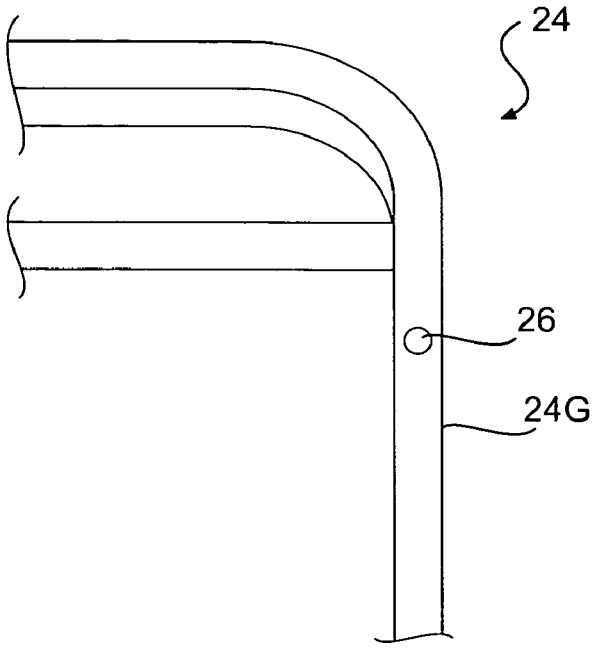
FIG. 10 is a view of a walker with the alternate embodiment of the present invention removed.
Figure 11:
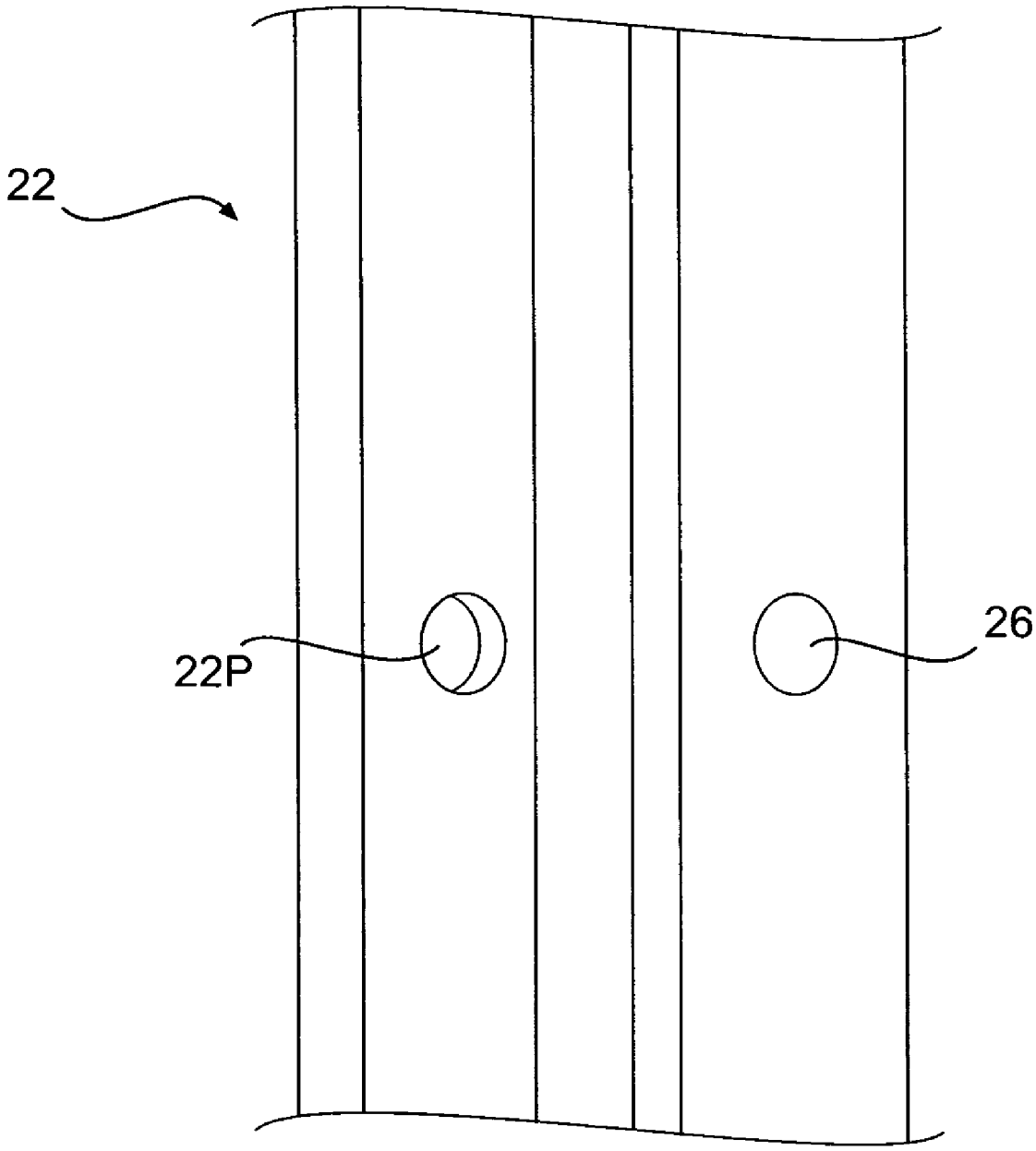
FIG. 11 is a view of the inner surface of the alternate embodiment of the present invention and the hand bar of a walker.
Figure 12:
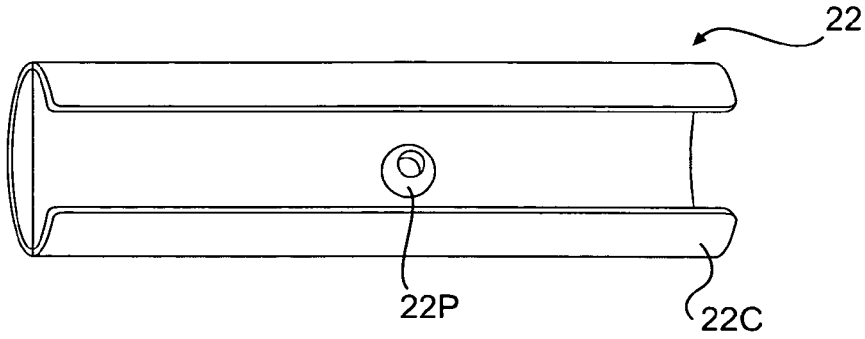
FIG. 12 is a view of the inner surface of the alternate embodiment of the present invention.

FIG. 2 shows another view of the present invention installed on a walker type of framed device 24. For contrast, FIG. 10 shows a corresponding view of gripping portion 24G of framed device 24 without the present invention; this view reveals that the gripping portion 24G defines an external surface with at least one hole 26 normal to the external surface. Gripping portion 24G may have at least one hole 26 passing all the way through, or simply on one side of a tubular framed device 24, as further described herein.

The hand grip 22 shown in the drawings is formed from a semi-rigid plastic or other elastic material. For example, the hand grip 22 can also be formed from a rigid foam, spring steel, or a molded composite. The material must be fairly durable to withstand regular use and must have a memory characteristic which allows the hand grip 22 to be deformed for installation, yet return to a configuration which is snug about the framed device 24. Preferably, for sanitary reasons, the material is non-absorbent. If desired, the hand grip 22 outer surface 22Y can be coated with a deformable cushion material for added comfort. The hand grip 22 is generally elliptical in shape to fit around the generally or substantially elliptical tubing commonly used for constructing the gripping portion 24G of such framed mobility devices. If needed, other aspects of the hand grip 22 can be formed in other shapes. For example, the hand grip 22 can have either curved ends 30 or straight ends 32 as shown particularly in FIGS. 6*a*, 6*b*, 14 and 15.

FIGS. 3-8 show aspects of the present invention. Hand grip 22 includes a non-absorbent grip cover 22C having a substantially elliptical cross section corresponding approximately to the cross section of the gripping portion 24G of framed device 24. Thus, grip cover 22C defines an interior space 22S adapted to receive the gripping portion 24G of framed device 24.

Figure 5:
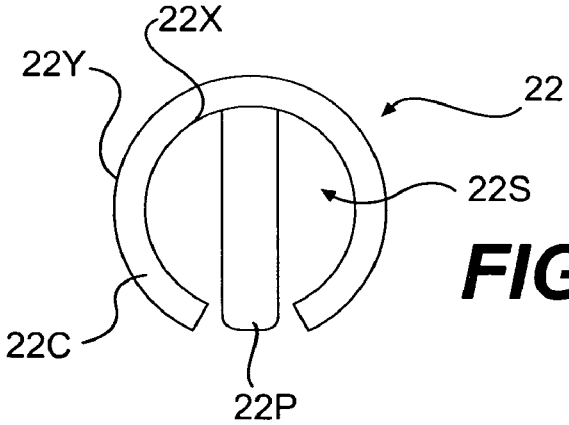
FIG. 5 is an end view of the hand grip.
Figure 6A:
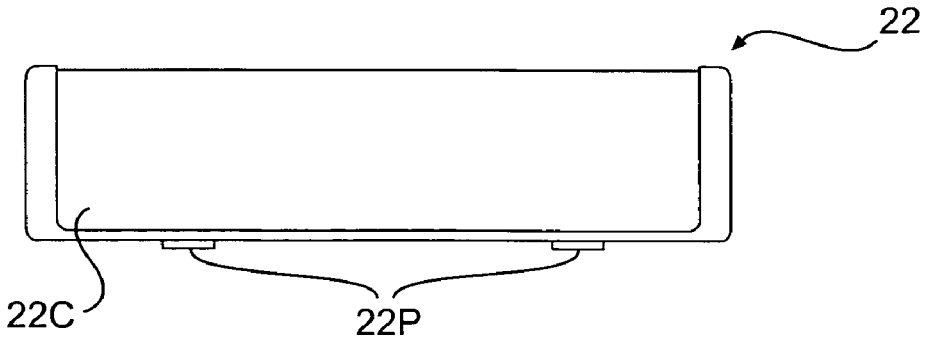
FIGS. 6*a* and 6*b* are side views of the present invention showing two alternate embodiments of the ends of the hand grip.
Figure 6B:
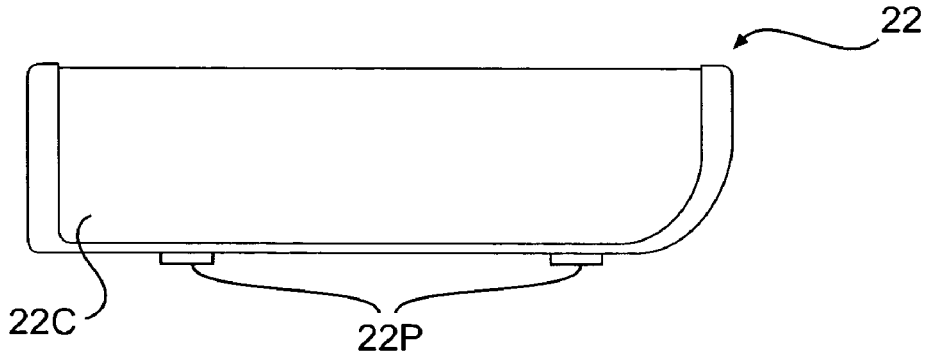
Figure 7:
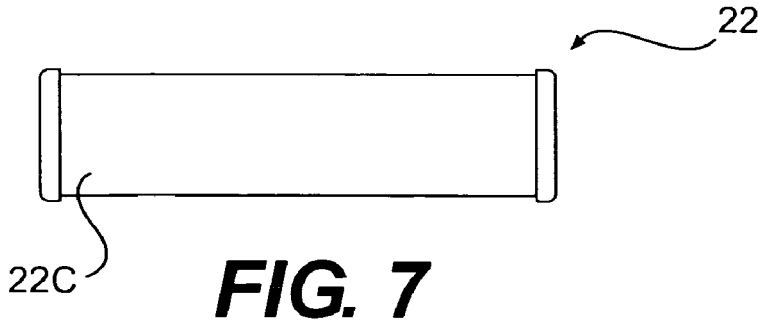
FIG. 7 is a top view of the hand grip.

As may be seen with reference to the end view of FIG. 5, grip cover 22C defines an inner surface 22X disposed on the portion of the grip cover 22C facing the interior space 22S and an outer surface 22Y disposed on the grip cover 22C facing away from the inner surface 22X. As may be seen in FIGS. 3 and 5, at least one pin 22P is mounted normally on the inner surface 22X of the grip cover 22C.

The at least one pin 22P is positioned or integrally mounted on the internal surface 22X of grip cover 22C in a normal fashion so as to be able to be aligned or mate with a corresponding at least one hole 26 on the gripping portion 24G of the framed device 24. Thus, the inner surface 22X of grip cover 22C is shown disposed on the portion of the hand grip 22 to face and substantially surround gripping portion 24G of framed device 24. Outer surface 22Y, being disposed on the portion of the grip cover 22C facing away from the inner surface 22X is adapted to receive the hand of a user (not shown).

Figure 3:
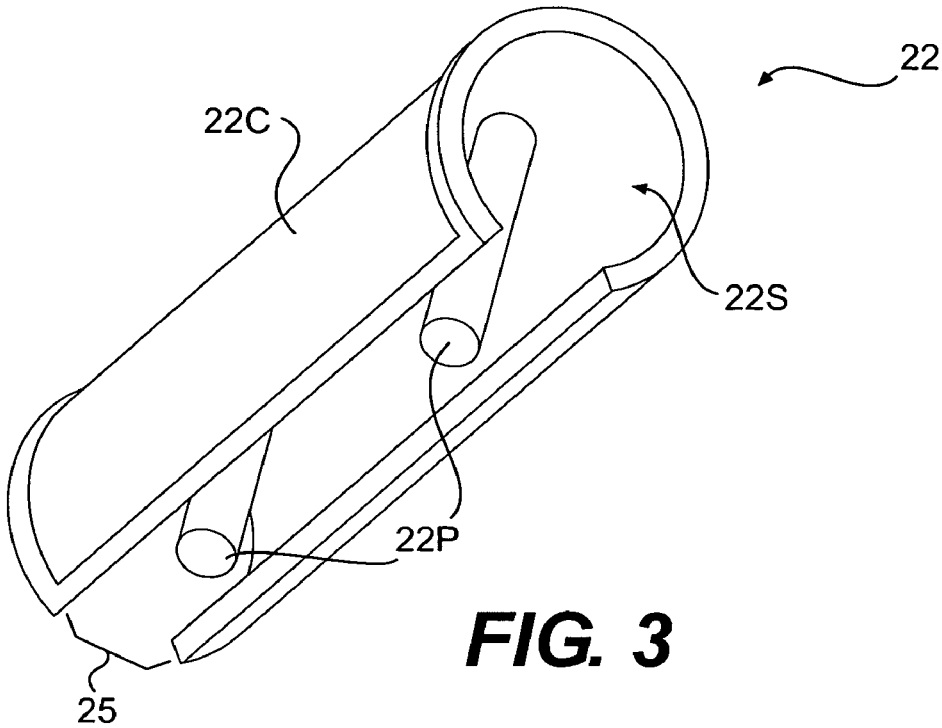
FIG. 3 is a bottom perspective view of the preferred embodiment of the present invention.
Figure 4:
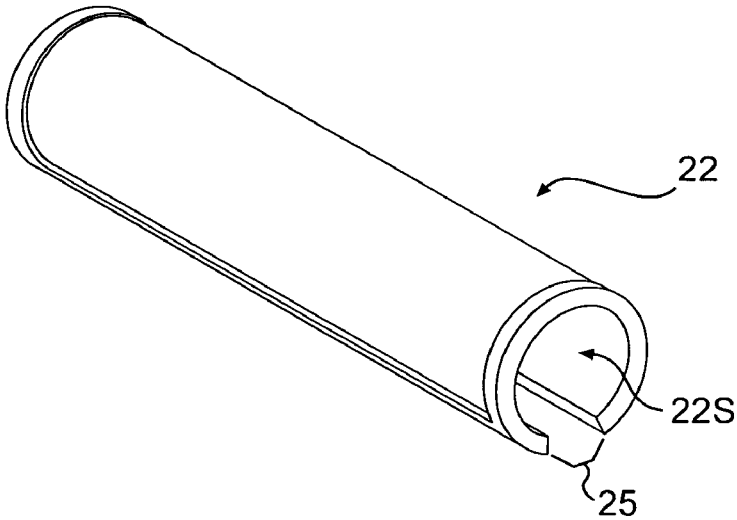
FIG. 4 is a top perspective view of the preferred embodiment of the present invention.

Grip cover 22C defines a longitudinally extending opening 25 along its length, as may be seen in FIG. 3, so that the substantially elliptical cross section of grip cover 22C thus forms a C-shape. As noted above, replaceable hand grip 22 is fabricated of an elastic material, so as to form a C-shaped spring. The transverse dimension or width of opening 25 is preferably less than the diameter or width of gripping portion 24G when the grip cover is relaxed. In one embodiment, the transverse arc of opening 25 is no more than 120-degrees when the grip cover is relaxed. Grip cover 22C may be deformed by a user to open the C-shape so that opening 25 is expanded in the transverse direction. This permits the grip cover 22C to be placed around the gripping portion 24G of framed device 24. When placed around gripping portion 24G grip cover 22C may be released so that the deformation is relaxed and grip cover 22C substantially surrounds gripping portion 24G. Limiting the transverse width of opening 25 to less than the width of gripping portion 24G, or the arc of opening 25 to no more than 120-degrees, have been shown to produce secure fits as the elastic C-shaped spring operates to force pin 22P into hole 26 securely. Aside from producing an insecure fit, openings 25 that are too large in the transverse direction may also produce an uncomfortable feel for gripping as the user's fingers might extend beyond the coverage of hand grip 22.

The C-shaped spring of hand grip 22 relates to the elliptical cross section of gripping portion 24G, in that a user is likely to deform grip cover 22C by pressing grip cover 22C against gripping portion 24G with opening 25 applied to gripping portion 24G and at least one pin 22P aligned with at least one hole 26. Thus, gripping portion 24G would operate to deform grip cover 22C as gripping portion 24G enters interior space 22S, expanding the transverse width of opening 25 as grip cover 22C slides over gripping portion 24G. Thus, "substantially elliptical" should generally be construed as lacking irregularities in shape that would impede such a process. However, some irregularities in the cross section of gripping portion 24G may not interfere or impede with this process, such as one falling at a point of gripping portion 24G corresponding to opening 25 when grip cover 22C substantially surrounds gripping portion 24G. Another non-interfering irregularity might be one that is located on gripping portion 24G so as not to contact grip cover 22C until grip cover 22C substantially surrounds gripping portion 24G; such an irregularity may mate with a corresponding inverse irregularities on inner surface 22X of grip cover 22C. Note that an opening 25 having a smaller transverse width may contact more of the surface of gripping portion 24G increasing a need for regularity, with the converse applicable as well.

Figure 8:
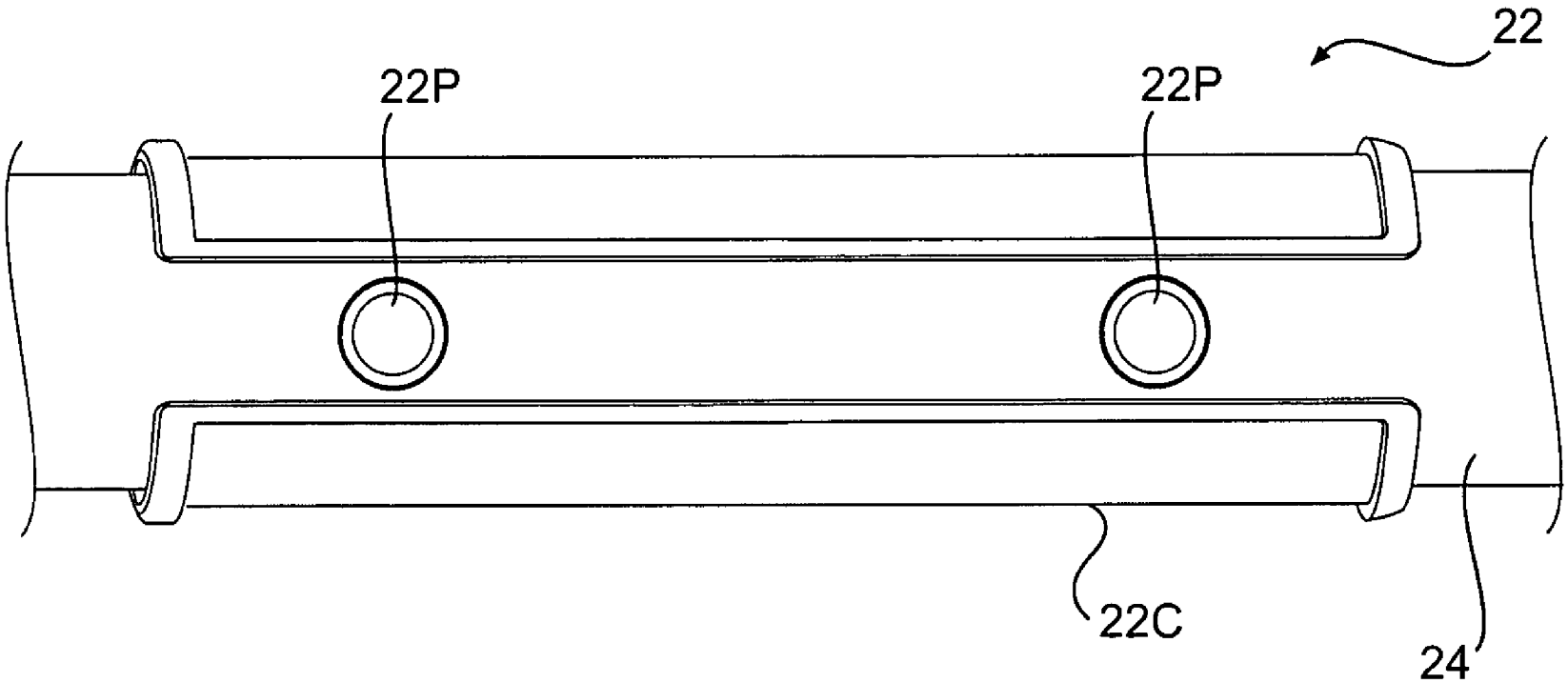
FIG. 8 is a view of the preferred embodiment of the present invention from below as seen in use.

When in place, the hand grip 22 is prevented from moving relative to the framed device 24 by the mating of at least one pin 22P with the at least one hole 26. That is, the at least one pin 22P extends from inner surface 22X of the grip cover 22C for a sufficient length so as to extend into the at least one hole 26 of the gripping portion 24G when the grip cover 22C is substantially surrounding the gripping portion 24G of the framed device 24. Some framed devices 24 may have at least one hole 26 running completely through the tubular structure of the gripping portion 24G; for such embodiments, hand grip 22 may have an at least one pin 22P that extends substantially through as well, mating with at least one hole 26, as shown in FIG. 8. This embodiment can provide enhanced stability for the hand grip 22. If desired for some highly secure embodiments, the cross section of the at least one pin 22P may be substantially similar or proximate to the cross section of the at least one hole 26, such that the pin 22P is compressed upon its mating with the hole 26. However, replacement of hand grip 22 for such embodiments may be more difficult.

Figure 18:
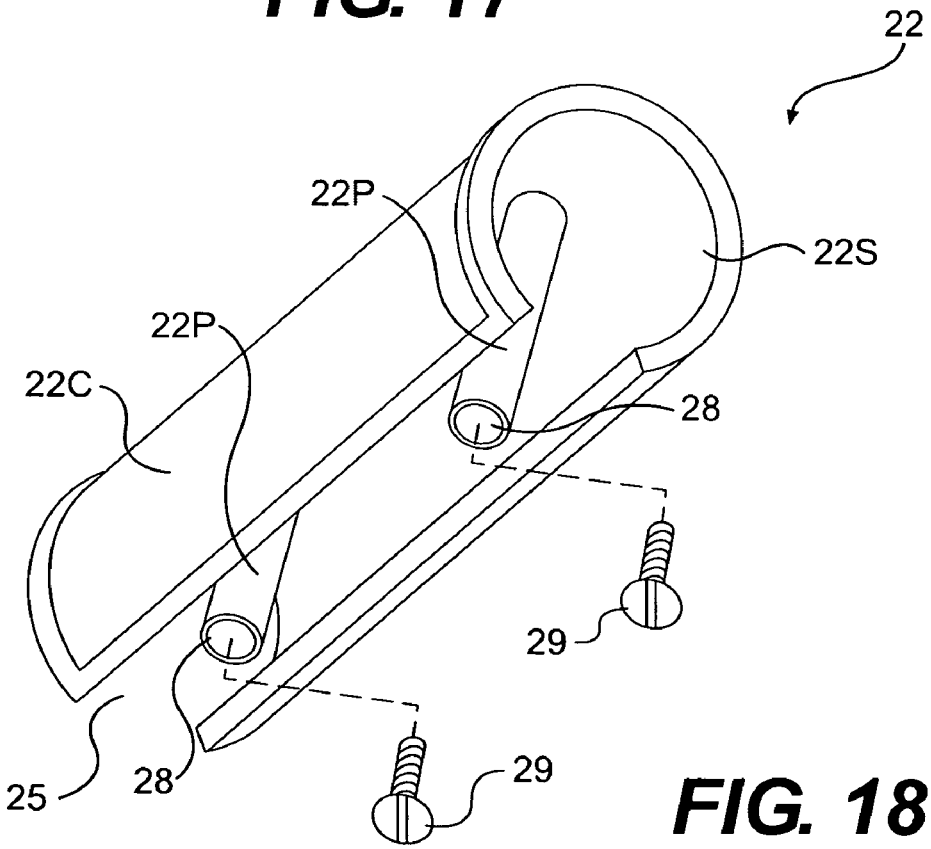
FIG. 18 is an alternate embodiment of the present invention.

With reference to FIG. 18, pin 22P may be hollow to form hollow portion 28 along its length, open at the end to be adapted to receive a fastener 29 to connect to or to engage with pin 22P, if desired. For such alternative embodiments, hole 26 extends through gripping portion 24G. The fastener 29 may be a screw, plastic snap-in pin, pop rivet or other such device. Pin 22P may be of sufficient length so as to extend into hole 26. The point of engagement between pin 22P and fastener 29 may occur at any point along hole 26, so long as fastener 29 and pin 22P may securely meet and engage as desired.

Figure 9:
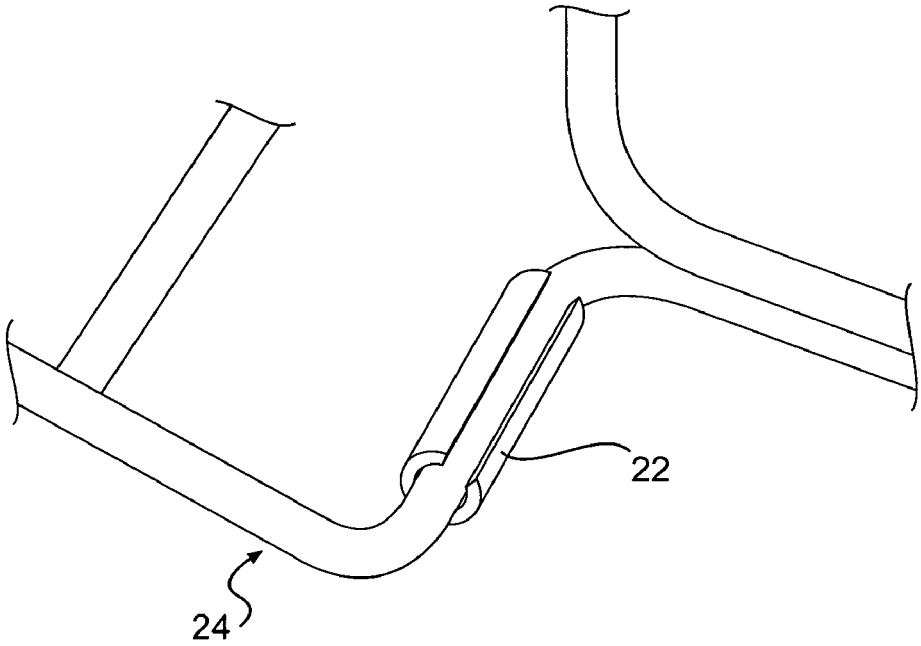
FIG. 9 is a view of the alternate embodiment of the present invention from below.

FIGS. 9-13 show embodiments of the invention adapted for a framed device 24, which is shown as a walker, having one or more holes 26 that do not pass completely through gripping portion 24G. In this embodiment, the at least one pin 22P extends into and mates with at least one hole 26 but does not exit. FIG. 9 shows this embodiment in which hole 26 does not pass all the way through the tubular structure of framed device 24, as may be seen along opening 25 in grip cover 22C. As described previously, each pin 22P formed on the inner surface 22X of the grip cover 22C extends into and mates with a hole 26 on the gripping portion 24G of framed device 24. The pin 22P may be formed from the same material as the rest of hand grip 22, as shown. Alternatively, the at least one pin 22P may be metal, molded to a plastic, or other material. However, it is desirable that pin 22P and grip cover 22C for a single, integrated piece in hand grip 22 for simplicity of assembly and replacement.

Figure 13A:
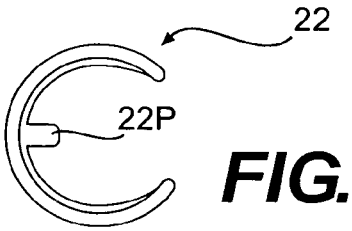
FIGS. 13*a* and 13*b* are end views of alternate embodiments of the present invention.
Figure 13B:
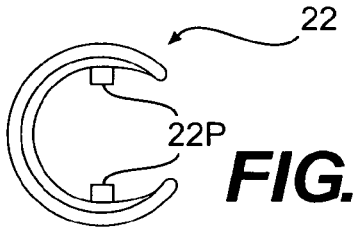
Figure 14:
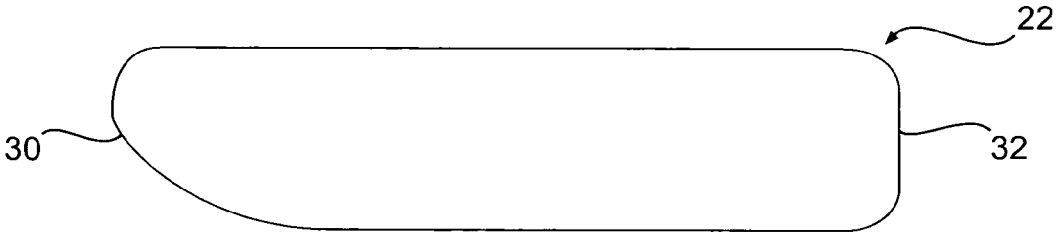
FIG. 14 is a side view of the alternate embodiment of the present invention showing 2 alternate embodiments of the ends.
Figure 15:
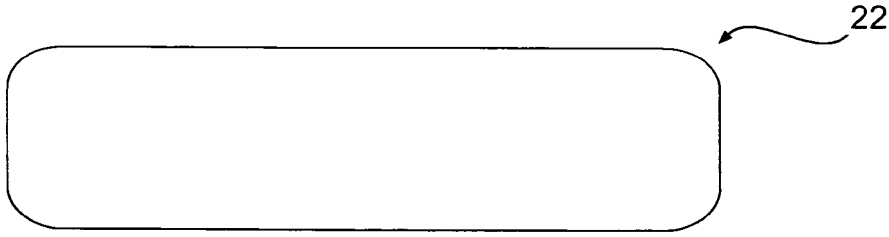
FIG. 15 is a top view of the alternate embodiment of the present invention.
Figure 16:
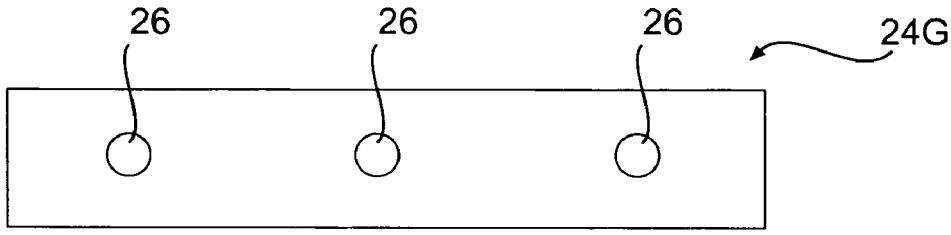
FIG. 16 is a view of an alternate hand bar of a walker.
Figure 17:
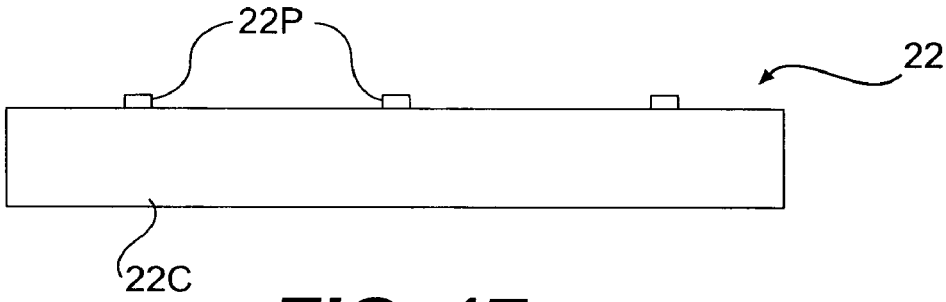
FIG. 17 is a view of an alternate embodiment of a hand grip matching the walker of FIG. 16.

By using more than one hole 26 and pin 22P, additional stability may be provided, depending on the application. Furthermore, the pin 22P need not be located along the center of the hand grip 22 as shown in FIG. 13*a*. The pin 22P can be mounted normally on the sides of the hand grip 22 as shown in FIG. 13*b*. Furthermore, embodiments having multiple pins 22P and multiple holes 26 need not have them all in a straight line or directly opposite each other, so long as each pin 22P mates with a hole 26.

While the preferred embodiment of the present invention shows one specific geometric design for mating the replaceable hand grip 22 to a mobility framed device 24, other designs are considered within the scope of this invention. The design must prevent the hand grip 22 from slipping around or along the structure of the mobility framed device 24.

Many improvements, modifications, and additions will be apparent to the skilled artisan without departing from the spirit and scope of the present invention as described herein and defined in the following claims.

What is claimed is:

1. A replaceable hand grip for a framed device having a gripping portion with a substantially elliptical cross section, the gripping portion defining an external surface with at least one hole normal to the external surface, the replaceable hand grip comprising:

a non-absorbent grip cover having a substantially elliptical cross section corresponding approximately to the cross section of the gripping portion and defining an interior space adapted to receive the gripping portion;

wherein the grip cover defines an inner surface disposed on the portion of the grip cover facing the interior space and an outer surface disposed on the grip cover facing away from the inner surface, the outer surface of the grip cover being adapted to receive a user's hand;

at least one pin integrally mounted normally on the inner surface of the grip cover in a location corresponding to the at least one hole in the gripping portion external surface, so as to form a single integrated piece with the grip cover;

wherein the grip cover is fabricated from an elastic material, and defines a longitudinally extending opening along its entire length, so the substantially elliptical cross section of the grip cover forms a C-shaped spring permitting the grip cover to be deformed to expand the opening in the transverse direction so that the grip cover may be placed around the gripping portion of the framed device with the interior space receiving the gripping portion, and upon relaxation of the deformation, the elastic grip cover substantially surrounds the gripping portion; and wherein the at least one pin may be aligned with the at least one hole, such that it extends from the inner surface of the grip cover for a sufficient length so as to extend into the at least one hole of the gripping portion when the grip cover is substantially surrounding the gripping portion of the framed device so as to secure the grip cover in place.

2. The replaceable hand grip of claim 1, wherein the transverse width of the longitudinally extending opening is less than the width of the gripping portion when the grip cover is relaxed and not substantially surrounding the gripping portion.

3. The replaceable hand grip of claim 1, wherein the transverse arc of the longitudinally extending opening is no more than 120-degrees when the grip cover is relaxed and not substantially surrounding the gripping portion.

4. The replaceable hand grip of claim 1, wherein the size of the cross section of the at least one pin is substantially proximate to the size of the cross section of the at least one hole.

5. The replaceable hand grip of claim 1, wherein the size of the cross section of the at least one pin is substantially proximate to the size of the cross section of the at least one hole, such that the pin is compressed upon its extending into the at least one hole.

6. The replaceable hand grip of claim 1, wherein the pin is mounted onto the inner surface of the grip cover at a point opposite the longitudinally extending opening.

7. The replaceable hand grip of claim 1, wherein at least one hole of the gripping portion extends through the gripping portion and the at least one pin is of sufficient length to extend through the at least one hole and the gripping portion.

8. The replaceable hand grip of claim 1 wherein the at least one pin is hollow along its length so as to define an open hollow portion adapted to receive a fastener capable of engaging the hollow portion of the pin.

9. The replaceable hand grip of claim 1 wherein at least one hole extends through the gripping portion, and the at least one pin is of sufficient length to extend into the at least one hole, wherein the at least one pin is hollow along its length so as to define an open hollow portion adapted to receive a fastener capable of engaging the hollow portion of the pin.

10. The replaceable hand grip of claim 1 wherein at least one hole extends through the gripping portion, and the at least one pin is of sufficient length to extend into the at least one hole, wherein the at least one pin is hollow along its length so as to define an open hollow portion adapted to receive a fastener capable of engaging the hollow portion of the pin, wherein the fastener is selected from the group consisting of a screw, a snap-in pin, and a pop rivet.

11. The replaceable hand grip of claim 1, wherein the grip cover outer surface is coated with a deformable material.

* * * * *